US008591076B2

(12) United States Patent
Lessard et al.

(10) Patent No.: US 8,591,076 B2
(45) Date of Patent: Nov. 26, 2013

(54) PHOSPHOR SHEET HAVING TUNABLE COLOR TEMPERATURE

(75) Inventors: Jason Lessard, Bow, NH (US); Edward Otto, Henniker, NH (US)

(73) Assignee: Osram Sylvania Inc., Danvers, MA (US)

( * ) Notice: Subject to any disclaimer, the term of this patent is extended or adjusted under 35 U.S.C. 154(b) by 155 days.

(21) Appl. No.: 13/410,662

(22) Filed: Mar. 2, 2012

(65) Prior Publication Data

US 2013/0229784 A1 Sep. 5, 2013

(51) Int. Cl.
*F21V 17/02* (2006.01)

(52) U.S. Cl.
USPC ..... 362/320; 362/84; 362/231; 313/512

(58) Field of Classification Search
USPC ..... 362/84, 231, 317, 318, 277, 278, 320; 313/501, 511; 250/503.1
See application file for complete search history.

(56) References Cited

U.S. PATENT DOCUMENTS 3,439,973 A * 4/1969 Weiss et al. ..... 359/352
3,886,310 A * 5/1975 Guldberg et al. ..... 348/771
3,924,929 A * 12/1975 Holmen et al. ..... 359/514
4,228,437 A * 10/1980 Shelton ..... 343/909
7,148,497 B2 * 12/2006 Gardner ..... 250/503.1
7,319,246 B2 1/2008 Soules et al.
7,323,702 B2 * 1/2008 Newsome ..... 250/504 H
7,858,998 B2 12/2010 Negley
8,022,626 B2 9/2011 Hamby et al.
2006/0268537 A1 * 11/2006 Kurihara et al. ..... 362/34
2010/0067229 A1 3/2010 Scotch et al.
2010/0067240 A1 3/2010 Selverian et al.
2010/0067241 A1 3/2010 Lapatovich et al.
2010/0182766 A1 * 7/2010 Lai ..... 362/84
2011/0031516 A1 2/2011 Basin et al.
2011/0309395 A1 12/2011 Van Den Berge

* cited by examiner

*Primary Examiner* — Ali Alavi
(74) *Attorney, Agent, or Firm* — Edward S. Podszus

(57) ABSTRACT

A white-light emitter is disclosed, in which light from blue light-emitting diodes strikes an active area of a phosphor sheet. The active area absorbs a portion of the blue light and emits phosphor light in response to the absorbed blue light. The emitter includes a stretcher that controllably stretches the active area of the phosphor sheet. The white light output spectrum of the active area has a characteristic color temperature that increases as the phosphor sheet is stretched, and decreases as the phosphor sheet contracts. As the phosphor sheet is stretched, the thickness of the active area decreases, the received blue light encounters fewer phosphor particles within the active area, the absorbed portion of the blue light decreases, the emitted phosphor light decreases, and the active area has a white light output spectrum that becomes weighted more heavily toward the blue light and less heavily toward the phosphor light.

15 Claims, 3 Drawing Sheets

PHOSPHOR SHEET HAVING TUNABLE COLOR TEMPERATURE

TECHNICAL FIELD

The present invention relates to a tunable light source, including light from a light emitting diode and a sheet that includes phosphor particles.

BACKGROUND OF THE INVENTION

There is a long history of light fixtures that have an adjustable color output. For instance, there are theater light fixtures that include a bright, white incandescent bulb, with replaceable colored gels or filters that can be cycled into and out of the beam as desired. Although commonly used, these fixtures commonly produce a great deal of heat, and use a significant amount of electrical power to power the incandescent bulb. In addition, the bulbs need periodic replacement.

It would be advantageous to have a tunable light fixture that uses one or more light emitting diodes (LEDs) as its light source. Compared with a conventional incandescent-based fixture, an LED-based system could be smaller, could use less power, and may require less maintenance.

SUMMARY OF THE INVENTION

An embodiment is a method for tuning a white-light emitter. An elastic phosphor sheet is illuminated with blue light. The elastic phosphor sheet emits white light having a characteristic color temperature. Tension is applied to the elastic phosphor sheet to controllably stretch the elastic phosphor sheet. The characteristic color temperature of the emitted white light varies with the amount of stretching of the elastic phosphor sheet.

Another embodiment is a white-light emitter. A phosphor sheet has an active area. The active area receives blue light, absorbs a portion of the blue light and emits white light in response to the absorbed blue light. A stretcher controllably stretches the active area of the phosphor sheet.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION OF THE INVENTION

In this document, the directional terms "up", "down", "top", "bottom", "side", "lateral", "longitudinal" and the like are used to describe the absolute and relative orientations of particular elements. For these descriptions, it is assumed that light exits through a "front" of the light emitter, with a spatial distribution centered around a longitudinal axis that is generally perpendicular to the front of the light emitter. The phosphor sheet may be described as being "in front of" or "longitudinally adjacent to" the blue light-emitting diode(s). It will be understood that while such descriptions provide orientations that occur in typical use, other orientations are certainly possible. The noted descriptive terms, as used herein, still apply if the emitter is pointed upward, downward, horizontally, or in any other suitable orientation.

A white-light emitter is disclosed, in which light from one or more blue light-emitting diodes strikes an active area of a phosphor sheet. The active area absorbs a portion of the blue light and emits phosphor light in response to the absorbed blue light. The emitter includes a stretcher that controllably stretches the active area of the phosphor sheet. The white light output spectrum of the active area has a characteristic color temperature that increases as the phosphor sheet is stretched, and decreases as the phosphor sheet contracts. As the phosphor sheet is stretched, the thickness of the active area decreases, the received blue light encounters fewer phosphor particles within the active area, the absorbed portion of the blue light decreases, the emitted phosphor light decreases, and the active area has a white light output spectrum that becomes weighted more heavily toward the blue light and less heavily toward the phosphor light.

The above paragraph is merely a generalization of several of the elements and features described in detail below, and should not be construed as limiting in any way.

Figure 1:
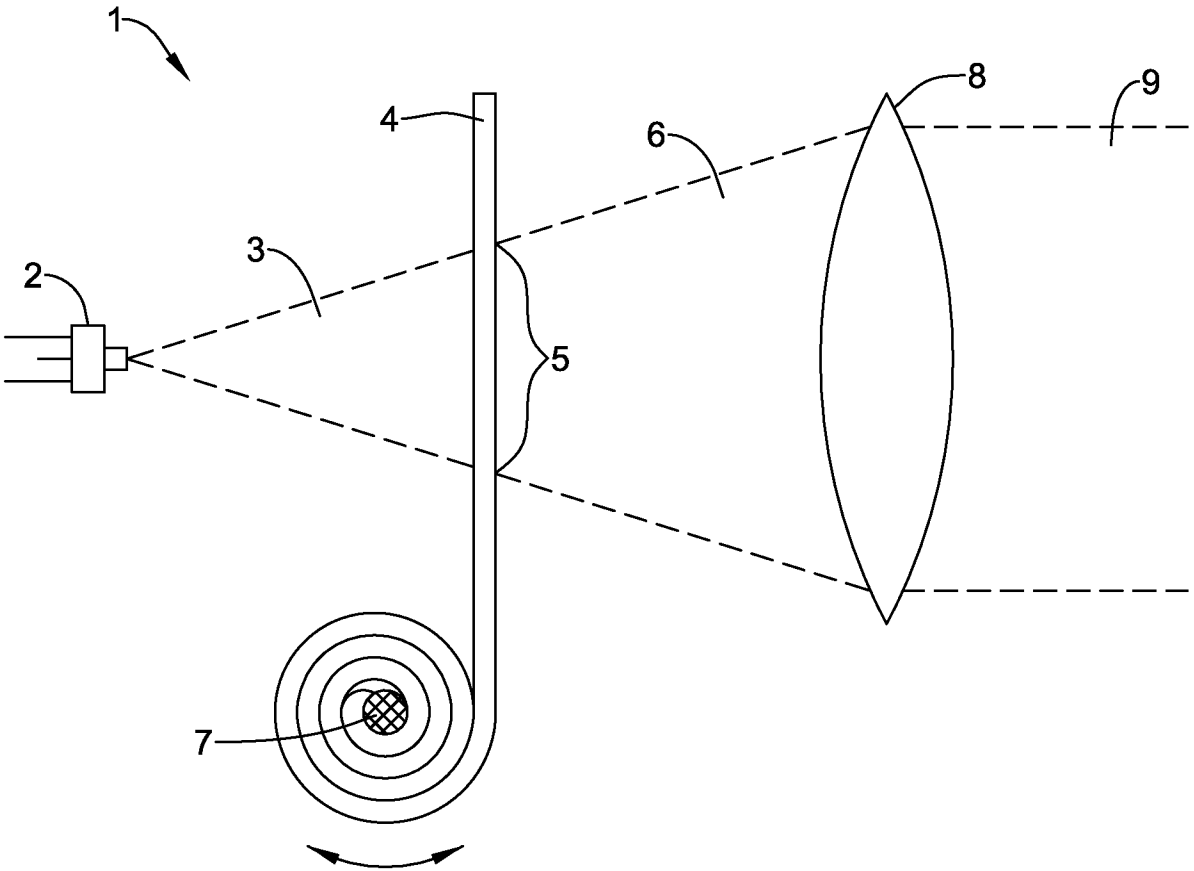
FIG. 1 is a side-view drawing of a light-emitter.

FIG. 1 is a side-view drawing of an exemplary configuration of a light-emitter 1. It will be understood that this configuration is merely an example, and that other configurations may be used as well.

The light-emitter 1 includes an array 2 of one or more blue light-emitting diodes (LEDs) as its light source. The LED array 2 is drawn in FIG. 1 as being a single LED, but any suitable number of LEDs may be used. The individual LEDs in the array 2 are typically laid out in a rectangular or square pattern. The LED array 2 may have a lateral footprint that is round, elliptical, square, rectangular, or some other suitable shape.

The LEDs in the array 2 may all have the same output wavelength, or may optionally use different wavelengths for at least two of the LEDs. In most cases, at least one of the LEDs 2 has a wavelength in the blue portion of the spectrum, in the range of 450 nm to 475 nm, or in the violet portion of the spectrum, in the range of 380 nm to 450 nm. Emitted wavelengths shorter than 380 nm may also be used, but such short wavelengths are considered to be in the ultraviolet portion of the spectrum, where transmission through common glass may be difficult or impossible. For the purposes of this document, the term "blue" may be used to refer to the wavelength ranges of 450-475 nm, 450-500 nm, 400-475 nm, 400-500 nm, 400-450 nm, 380-475 nm, 380-500 nm, less than 450 nm, less than 475 nm, and/or less than 500 nm.

In general, the spectral output of a light emitting diode has a distribution, usually described by center wavelength and a bandwidth. The bandwidth is often given as a full-width-at-half-maximum (FWHM) of output power. Typical FWHM bandwidths for common LEDs are in the ranges of 15-40 nm, 15-35 nm, 15-30 nm, 15-25 nm, 15-20 nm, 20-40 nm, 20-35 nm, 20-30 nm, 20-25 nm, 25-40 nm, 25-35 nm, 25-30 nm, and/or 24-27 nm.

The LED array 2 may lie generally perpendicular to a longitudinal axis, so that the surface normal of the LED array 2 is parallel to the longitudinal axis. In general, LEDs 2 have a directional output, so that the most light is emitted perpendicular to the face of the chips. At angles farther away from the surface normal, the light output decreases, so that parallel to the chips, the light output is essentially zero. In many cases, the angular light output of the bare LED chips may follow a Lambertian distribution. There may be an optional condenser lens that directs the bare output of the LED array 2 onto the phosphor sheet 4.

The blue light produced by the LED array 2 is referred to in this document as "excitation light" 3. The excitation light 3 is directed onto a phosphor sheet 4 that absorbs the excitation light 3, in the blue portion of the spectrum, and emits light with a longer wavelength, which is referred to in this document as "phosphor light". The light that exits the phosphor sheet 4 is a combination of the excitation light 3 and the phosphor light, and is denoted as "white light" 6.

The portion 5 of the phosphor sheet that receives the excitation light 3 is referred to as an "active area" 5. In general, the active area 5 is determined by the footprint of the excitation light 3, although there may be an additional aperture to further limit the active area 5. Typically, as the phosphor sheet 4 is stretched, released or otherwise deformed, the active area 5 remains a constant size.

In many cases, it is desirable to collimate the white light 6 or reduce its divergence with an optional lens 8. Such a lens 8 narrows the angular spread of the light from the chips, which may be beneficial in particular applications, like theater spotlights. The lens 8 is placed after the phosphor sheet 4, with the phosphor sheet being located at or near a focal plane of the lens 8. The angular divergence of the white light 6 is reduced by the lens 8 to form reduced-divergence white light 9, which is directed out of the light fixture 1.

The spectral properties of the phosphor light are strongly dependent on the phosphor, but common phosphors emit light with a relatively large bandwidth over the remainder of the visible spectrum, typically from 475-750 nm. For many previously-known devices, the phosphor composition is chosen during the design phase of the device so that the phosphor light, combined with the excitation light, produces white light having a desired color temperature. Unlike those previously-known devices, the color temperature of the white light 6 is not determined solely by the phosphor composition, but is adjustable by the user.

The white light 6 is a combination of blue excitation light 3 and longer-wavelength phosphor light. The color temperature is adjusted by varying the relative amounts of blue excitation light 3 and longer-wavelength phosphor light. If the amount of excitation light 3 is increased and/or the amount of phosphor light is decreased, the white light 6 appears more "blue", and the color temperature of the white light 6 increases. Likewise, if the amount of excitation light 3 is decreased and/or the amount of phosphor light is increased, the white light 6 appears less "blue", and the color temperature of the white light 6 decreases.

The relative amounts of excitation light and phosphor light may be selectively varied dynamically by changing the thickness of the phosphor sheet 4 in the vicinity of the blue excitation light 3. The phosphor sheet 4 is elastic, and its thickness is controlled by stretching and/or releasing the phosphor sheet 4 onto a roller or other suitable stretcher 7.

As the phosphor sheet 4 is stretched, the longitudinal thickness of the active area 5 decreases, the excitation light 3 encounters fewer phosphor particles within the active area 5, the absorbed portion of the blue light decreases, the emitted phosphor light decreases, and the white light 6 emerging from the active area 5 has an output spectrum that becomes weighted more heavily toward the blue excitation light 3 and less heavily toward the phosphor light.

Similarly, as the phosphor sheet 4 is released, the longitudinal thickness of the active area 5 increases, the excitation light 3 encounters more phosphor particles within the active area 5, the absorbed portion of the blue light increases, the emitted phosphor light increases, and the white light 6 emerging from the active area 5 has an output spectrum that becomes weighted more heavily toward the phosphor light and less heavily toward the blue excitation light 3.

The stretcher 7 shown in FIG. 1 is a roller, which rotates by a motor or a manual crank and rolls up one end of the phosphor sheet 4. The other end of the phosphor sheet 4, opposite the roller, is fixed in the configuration of FIG. 1. Alternatively, both ends may use rollers. As a further alternative, there may be additional rollers operating out of the plane of FIG. 1, which allow for stretching in more than one direction. To attach the phosphor sheet 4 to the roller, the stretcher 7 also includes a gripper that attaches to at least a portion of the phosphor sheet 4, usually at the perimeter, and a tensioner that applies tension to the phosphor sheet 4 through the gripper. Other possible stretchers include elements that pinch or grab the phosphor sheet 4 and translate laterally and/or longitudinally. All of these stretcher configurations controllably stretch the phosphor sheet 4, and controllably allow the phosphor sheet 4 to contract.

In general, as the lateral area of the phosphor sheet 4 is increased, its thickness decreases, so that its volume remains constant. If the lateral area is increased by a factor of two, then the thickness decreases by a factor of two, and so forth. The phosphor sheet may be stretched along one dimension, as is shown in FIG. 1, or may alternatively be stretched in two dimensions, as would be the case with two or more stretchers 7 operating along different azimuthal directions.

Note that a relatively large amount of stretching that may occur, such as increases in lateral area by a factor of two or more. Because such large stretching may rely on mechanical elements to perform the stretching, it is envisioned that the change in color temperature may occur relatively slowly. For instance, a change in color temperature may occur within a second or a fraction of a second, as the roller in FIG. 1 reaches stability. It is unlikely that mechanical elements would be able to accurately perform the stretching on a scale of kHz or MHz, which is usually the domain of electrical switching. For many applications, such as theater lighting, this relatively slow but dynamic change may be perfectly adequate. In some cases, the stretching may be used over a much longer time frame to dial into a particular target color temperature, and ensure the light emitter 1 remains at or close to the target color temperature over time.

The phosphor sheet 4 is formed from silicone, with phosphor particles embedded in the silicone. The phosphor particles have a concentration in the sheet between two percent and ten percent. In some cases, the phosphor particles are uniformly distributed throughout the entire phosphor sheet 4. In other cases, the phosphor particles are uniformly distributed, but only in the vicinity of the active area 5.

The phosphor sheet 4 is elastic, so that it stretches when under tension, and contracts when released from the tension. It is understood that the phosphor sheet 4 generally does not contract significantly beyond a relaxed state. Because the sheet 4 is elastic, it may be repeatedly stretched and contracted without permanent deformation. In general, the stretching and contracting does not exhibit any significant hysteresis.

Figure 2:
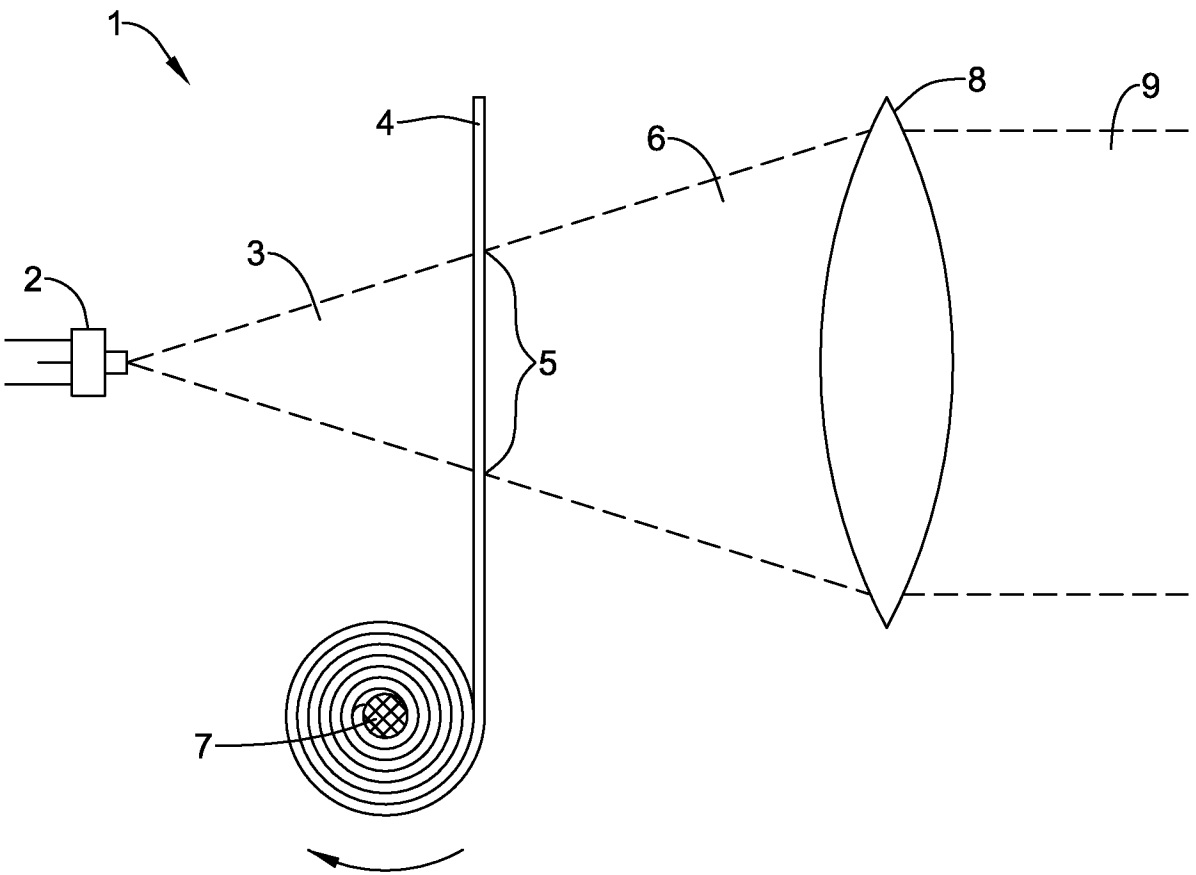
FIG. 2 is a side-view drawing of the light-emitter of FIG. 1, with the phosphor sheet in a stretched state.

FIG. 2 is a side-view drawing of the light-emitter 1 of FIG. 1, with the phosphor sheet 4 in a stretched state. Note that the roller in the stretcher 7 has rolled up a significant portion of the phosphor sheet 4. Note also that in the vicinity of the active area 5, the phosphor sheet 4 has a reduced longitudinal thickness. Because the density of phosphor particles within the volume of the phosphor sheet 4 remains constant, the excitation light 3 encounters fewer phosphor particles within the footprint of the beam. This results in less blue excitation light 3 being absorbed, and less phosphor light being produced. Compared to the spectrum in FIG. 1, the spectrum of the white light 6 is "bluer", with a higher color temperature.

Note that color temperature is a general measure of the "warmth" of a light source. The color temperature of light is defined as the temperature at which an ideal blackbody radiator most closely matches the light, for typical human color perception. Unlike the usual associations of hotter temperatures with "warmth", warmer or more "red" color temperatures are relatively low, while cooler or more "blue" color temperatures are relatively high. The color temperature of the white light 6 is tunable, by stretching and/or releasing the tension on the phosphor sheet 4, which changes its thickness.

Figure 3:
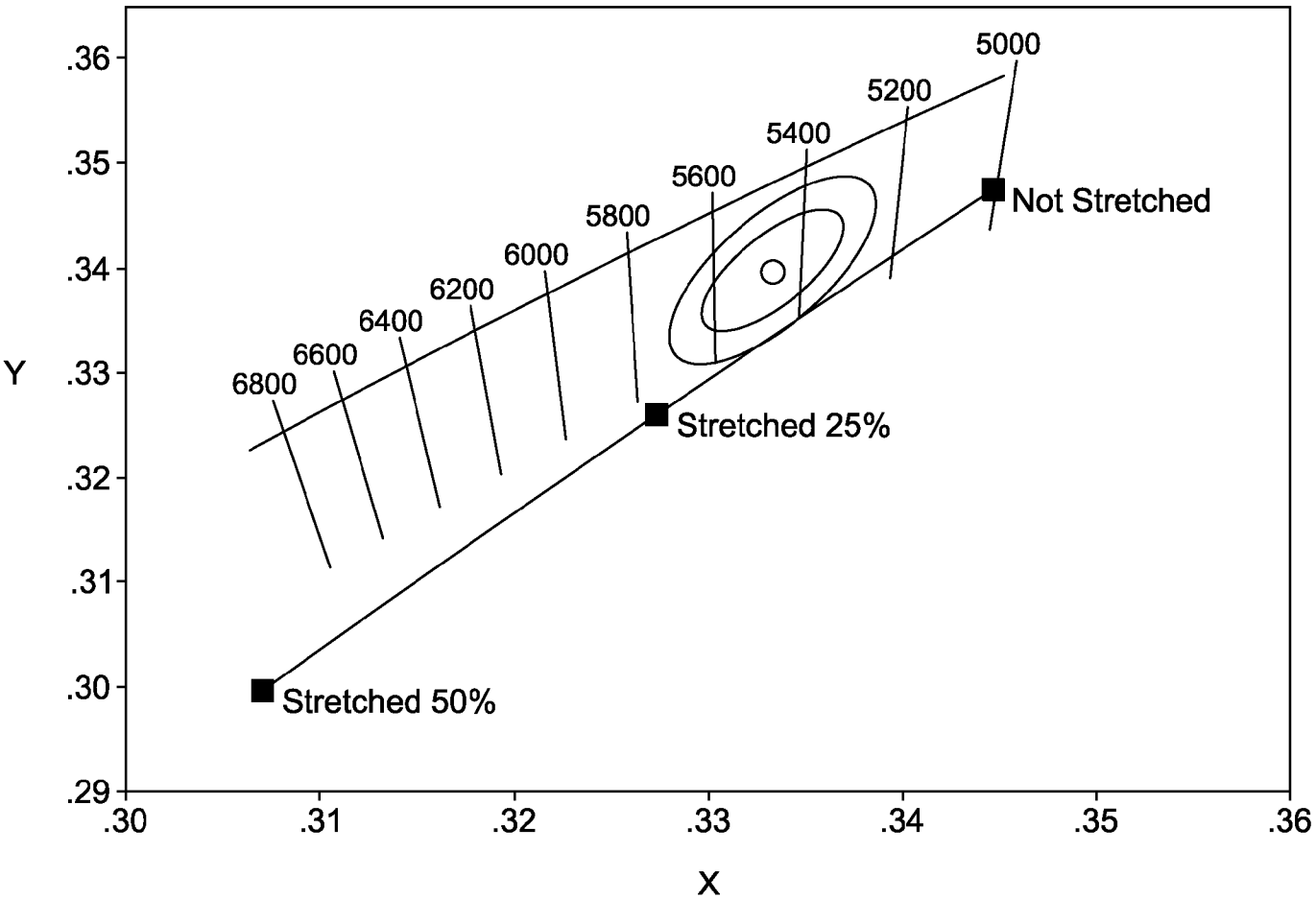
FIG. 3 is a plot of color temperature versus the amount of stretching of the phosphor sheet, for an exemplary phosphor sheet.

FIG. 3 is a plot of color temperature versus the amount of stretching of the phosphor sheet 4 needed to create a visible difference in color temperature within and outside the target color temperature range of 5450 K, as bounded by the two-step MacAdam ellipse.

The plot shows concentric ellipses surrounding the target, which represent contours of tolerance around the target. In particular, the ellipses in FIG. 3 are known as MacAdam ellipses. A MacAdam ellipse refers to an elliptical region centered at a target color on a chromaticity diagram. The size of the MacAdam ellipse defines the threshold at which color difference becomes perceivable to the average human eye (between any color contained within the ellipse and the color at the center of the ellipse). MacAdam ellipse sizes are quoted in "steps". Any point on the boundary of a one-step MacAdam ellipse, drawn around a target, represents a one Standard Deviation Color Match (SDCM) from the color at the center of the ellipse, which is the target color. Note that this also means that if you draw a line through the target from that point, thereby creating a point on the opposite boundary, the two boundary points will be two standard deviations from one another. Similarly, any point on the boundary of a two-step MacAdam ellipse represents two SDCM from the target color, and so on. Colors on the boundary of a one-step MacAdam ellipse are considered to be indistinguishable to the average human eye from the color at the center of the ellipse. Colors on the boundary of ellipses of five step sizes and up are considered readily distinguishable from the color at the center of the ellipse. Statistically, it is found that colors on the boundary of a one-, two- and three-step MacAdam ellipse are distinguishable from the color at the center of the ellipse for 68.27%, 95.45% and 99.73% of the general average-vision population, respectively.

The exemplary phosphor sheet, in an unstretched form, has a color temperature of about 5000 K. By stretching the phosphor sheet by 25% of its initial size (lateral area), its thickness is shrunk to 80% of its initial value, and its color temperature is raised to about 5900 K. By further stretching the phosphor sheet by 50% of initial size, its thickness is shrunk to 67% of its initial value, and its color temperature is raised to a value greater than 6800 K. Note that the numerical values of FIG. 3 correspond to a particular example, and that other suitable values may be achieved by selection of appropriate phosphors, appropriate phosphor concentration, and appropriate geometry for the phosphor sheet.

An exemplary manufacturing process for a suitable phosphor silicon sheet is as follows.

First, at least one phosphor is mixed with an optical grade silicone material to form a phosphor silicone mix. The mix of phosphors is chosen based on the desired spectrum of the phosphor light, and is typically chosen after simulation or through routine experimentation. The concentration level of the phosphor mix is typically between two percent and ten percent.

Next, the phosphor silicone mix is placed in a vacuum chamber and degassed. The vacuum level and time within the chamber are dependent on the volume of the phosphor silicone mix, and are conventional in the art and typically found through routine experimentation.

Next, the degassed phosphor silicone mix is spread on a platen of a mold. In some cases, the mold platen is self-leveling. It is beneficial to avoid creating air bubbles when filling the mold platen. Any noted air bubbles should be dislodged before installing the top half of the mold.

Next, the spread, degassed phosphor silicone mix is cured in a curing oven at an elevated temperature. The cure temperature and cure time are typically prescribed by the silicone manufacturer, and may be altered as needed through routine experimentation.

After curing, the mold is removed from the oven and is left out to cool to room temperature. The mold halves are then disassembled, and the cured silicone phosphor sheet is removed from the mold.

Unless otherwise stated, use of the words "substantial" and "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

PARTS LIST

1 light emitter
2 LED array
3 excitation light
4 phosphor sheet
5 active area
6 white light
7 stretcher
8 lens
9 reduced-divergence white light

What is claimed is:

1. A method for tuning a white-light emitter, comprising:

illuminating an elastic phosphor sheet with blue light, the elastic phosphor sheet emitting white light having a characteristic color temperature; and applying tension to the elastic phosphor sheet to controllably stretch the elastic phosphor sheet;

wherein the characteristic color temperature of the emitted white light varies with the amount of stretching of the elastic phosphor sheet.

2. The method of claim 1, wherein as the stretching of the elastic phosphor sheet increases, the characteristic color temperature of the emitted white light increases.

3. The method of claim 2, further comprising:

reducing tension to the elastic phosphor sheet to controllably reduce the stretching of the elastic phosphor sheet;

wherein as the amount of stretching of the elastic phosphor sheet decreases, the characteristic color temperature of the emitted white light decreases.

4. The method of claim 3, wherein the tension is applied and reduced dynamically to dynamically tune the characteristic color temperature of the emitted white light.

5. The method of claim 4, wherein the tuning of the characteristic color temperature of the emitted white light as a function of applied tension is free from hysteresis.

6. The method of claim 4, wherein the characteristic color temperature of the emitted white light is tuned without changing any characteristics of the blue light.

7. The method of claim 3, further comprising:

varying the tension to stretch the elastic phosphor sheet to a first size, the emitted white light having a first color temperature corresponding to the first size; and varying the tension to stretch the elastic phosphor sheet to a second size different from the first size, the emitted white light having a second color temperature corresponding to the second size, the second color temperature being different from the first color temperature.

8. The method of claim 1, wherein the emitted white light comprises phosphor light and the blue light;

wherein controllably stretching the elastic phosphor sheet varies a thickness of the elastic phosphor sheet in an area exposed to the blue light;

wherein the blue light encounters a number of phosphor particles within the elastic phosphor sheet, the number depending on the thickness of the elastic phosphor sheet in the area exposed to the blue light; and wherein the amount of phosphor light produced by the elastic phosphor sheet varies with the number of phosphor particles within the elastic phosphor sheet exposed to the blue light.

9. A white-light emitter, comprising:

a phosphor sheet having an active area, wherein the active area receives blue light, absorbs a portion of the blue light and emits white light in response to the absorbed blue light; and a stretcher that controllably stretches the active area of the phosphor sheet.

10. The white-light emitter of claim 9, wherein as the phosphor sheet is stretched:

the thickness of the active area decreases;

the received blue light encounters fewer phosphor particles within the active area;

the absorbed portion of the blue light decreases;

the emitted white light decreases;

the active area has an output spectrum that becomes weighted more heavily toward the blue light and less heavily toward the white light; and the output spectrum of the active area has a characteristic color temperature that increases.

11. The white-light emitter of claim 9, wherein the phosphor sheet is elastic; and wherein the stretcher controllably allows the phosphor sheet to contract.

12. The white-light emitter of claim 11, wherein as the phosphor sheet contracts:

the thickness of the active area increases;

the received blue light encounters more phosphor particles within the active area;

the absorbed portion of the blue light increases;

the emitted white light increases;

the output spectrum of the active area becomes weighted more heavily toward the white light and less heavily toward the blue light; and the characteristic color temperature of the output spectrum of the active area decreases.

13. The white-light emitter of claim 9, wherein the stretcher includes:

at least one roller; and a gripper that attaches to at least a portion of a perimeter of the phosphor sheet; and a tensioner that applies tension to the phosphor sheet through the gripper.

14. The white-light emitter of claim 9, wherein the active area of the phosphor sheet has a generally uniform density of phosphor particles throughout.

15. The white-light emitter of claim 9, wherein the phosphor sheet is formed from silicone and has phosphor concentration between two percent and ten percent.

* * * * *